United States Patent [19]

Levine

[11] Patent Number: 4,627,245

[45] Date of Patent: Dec. 9, 1986

[54] DE-ICING THERMOSTAT FOR AIR CONDITIONERS

[75] Inventor: Michael R. Levine, Ann Arbor, Mich.

[73] Assignee: Honeywell Inc., Minneapolis, Minn.

[21] Appl. No.: 699,580

[22] Filed: Feb. 8, 1985

[51] Int. Cl.[4] ..... G05D 23/32

[52] U.S. Cl. ..... 62/157; 62/234

[58] Field of Search ..... 62/155, 157, 158, 231, 62/234; 165/12; 236/46 F, 46 R

[56] References Cited

U.S. PATENT DOCUMENTS

| | | | |
|---|---|---|---|
| 4,094,166 | 6/1978 | Jerles | 62/158 |
| 4,136,730 | 1/1979 | Kinsey | 62/231 X |
| 4,356,962 | 11/1982 | Levine | 165/12 X |
| 4,453,590 | 6/1984 | Holliday et al. | 62/157 X |

*Primary Examiner*—Harry Tanner

*Attorney, Agent, or Firm*—Krass & Young

[57] ABSTRACT

An electronic de-icing thermostat adapted to be connected to an air-cooling apparatus, such as an air conditioner, to control its state of operation. The thermostat includes means for generating a digital electrical signal representative of a desired temperature setpoint, means for measuring the ambient temperature of the thermostat and means for generating control signals for deenergizing the compressor in the air-cooling apparatus for a first preselected period of time whenever the compressor is determined to have run continuously for a second preselected period of time in order to inhibit the accumulation of ice on the cooling element of the air-cooling apparatus. The device preferably includes means for adaptively adjusting the length of the second and/or first preselected periods of time as a function of the change in the rate of change of the ambient temperature measured during the operation of the air-cooling apparatus.

4 Claims, 4 Drawing Figures

DE-ICING THERMOSTAT FOR AIR CONDITIONERS

TECHNICAL FIELD

This invention relates to an electronic thermostat for measuring the temperature within a structure and controlling the energization of an air cooling apparatus for the structure, and more particularly to a thermostat which modifies the time period of operation of the air-cooling apparatus in order to prevent the accumulation of ice on the outer surface of the air-cooling element in the apparatus.

BACKGROUND ART

Thermostats for heating and/or air-cooling systems generally include means for storing a desire setpoint temperature, means for measuring the actual temperature within the building, and means for switching the heating or cooling unit on or off as a function of differences between the setpoint temperature and the actual temperature. Advances in microelectronics have led to development of programmable electronic thermostats which allow the user to program a schedule of temperature setpoints corresponding to selected times in a repetitive cycle. A principal advantage of programmable thermostats is that the user may program his thermostat to automatically set back the temperature of his building during selected periods of the day in order to conserve energy.

However, much of the potentially significant savings in energy costs may be undermined by the inefficient operation of an air-cooling system controlled by the thermostat. For example, the thermostat may be programmed to maintain the building at a temperature of 72° during periods of the day when persons are likely to be home, and maintain the temperature at 82° during periods when the building is empty. When the thermostat energizes the air-cooling unit to lower the room temperature to 72° from the setback point of 82° the unit may operate for an extended period of time in order to get back to the programmed setpoint. Extended continuous operation of the air-cooling unit is likely to result in the accumulation of ice on the evaporator and, thus, a significant loss in operating efficiency. This loss in operating efficiency requires the air cooling unit to operate for a still longer period of time in order to achieve the programmed setpoint, thus, undermining the energy savings achieved by setting back the temperature.

It is therefore an object of the present invention to provide an electronic thermostat including means for controlling the operation of an air-cooling unit to prevent the accumulation of ice on the cooling element of the unit thereby increasing the operating efficiency of the system.

It is another object of the present invention to provide an electronic thermostat having an automatic de-icing cycle which deenergizes the operation of the cooling element in the air-cooling unit for a first preselected period of time whenever the unit has operated continuously for a second preselected unit of time.

It is another object of the present invention to provide an electronic de-icing thermostat including means for adaptively modifying the length of either or both of the first and second preselected time periods in response to sensed temperature conditions in order to maximize the operating efficiency of the system.

SUMMARY OF THE INVENTION

The electronic thermostat of the present invention eliminates the accumulation of ice on the evaporator of a conventional air-cooling unit that would normally occur for an extended period of time, thereby increasing the operating efficiency of the unit.

In one embodiment of the invention, the thermostat automatically deenergizes the compressor pump in the air-cooling unit whenever that unit has operated continually for a second period of time exceeding a preselected "on cycle" limit, and maintains the compressor in a deenergized state for a first preselected period of time to allow the evaporator to warm up the so that any accumulation of ice is melted. It should be noted that during the deenergization of the evaporator unit, the fan is preferably left on so that relatively warmer air is blown over the evaporator, thus speeding up the de-icing process.

The system includes a pair of counters or registers, each set to a predetermined number corresponding respectively to the first and second preselected time periods, and a clock. When the thermostat issues a control signal to start the compressor pump, the clock outputs are counted for as long as the compressor pump continues to remain on. If this count should exceed the second preselected period of time corresponding to the "on cycle" limit, the system issues a signal which deenergizes the compressor unit. The compressor unit is maintained in an off state, preferably with the fan blowing warm air over the evaporator, until the reinitialized clock output count reaches the first preselected "off cycle" time. At this point the system provides a signal which reenergizes the compressor and repeats the cycle until the air-cooling unit has cooled the building to the desired temperature level.

In an alternative embodiment of the present invention, means are provided for adaptively controlling the period of time that the compressor is allowed to continuously operate as a function of the rate of change in the ambient temperature. In addition to the above-described components, the alternative embodiment includes means for sensing the ambient temperature, storage means for temporarily storing the values of temperatures ascertained at each point in time, and comparator means for comparing currently sensed ambient temperatures to those sensed at a previous point in time. The thermostat periodically interrogates the temperature sensor to obtain the current temperature and compares this temperature to the last obtained temperature to determine the change in temperature for that period of time. This change in temperature is compared to the temperature change calculated for the last preceding and second to last preceding time periods and compares this rate of change in the cooling rate to a preselected minimum threshold rate stored in the system's memory. If the change in the rate of change in the temperature is greater than the minimum threshold rate (that is, the change in the cooling rate is less than the minimum threshold rate) the system decrements the preselected "on cycle" time by one unit since the drop in the rate of cooling below this minimum level indicates that icing of the evaporator has begun. This logic also preferably provides the signal for deenergizing the compressor pump in order to begin the de-icing at this time.

After the compressor has been maintained in the off position for the preselected "off cycle" time period, the compressor may run continuously for the now shortened "on cycle" time period or until the change in cooling rate again falls below the preselected minimum threshold rate. If the cooling unit continues to operate for a time period exceeding the preselected "on cycle" time as determined by the counter described above, the system will provide a signal to deenergize the compressor for the appropriate "off cycle" time and will increment the value in the "on cycle" register. In this manner, the "on cycle" time limit is adaptively adjusted downward whenever the temperature-sensing logic determines that the evaporator is icing up earlier than expected, and the "on cycle" time is increased whenever the compressor continually operates for that amount of time without the system sensing a precipitous loss in the cooling rate.

In another embodiment of the invention, the second preselected time period corresponding to the "off cycle" time limit may be adaptively incremented and decremented in a manner similar to that described above.

Other objectives, advantages and applications of the present invention will be made apparent by the following detailed description of the preferred embodiments of the invention. The description makes reference to the accompanying drawings in which:

DESCRIPTION OF THE PREFERRED EMBODIMENT

Figure 1:
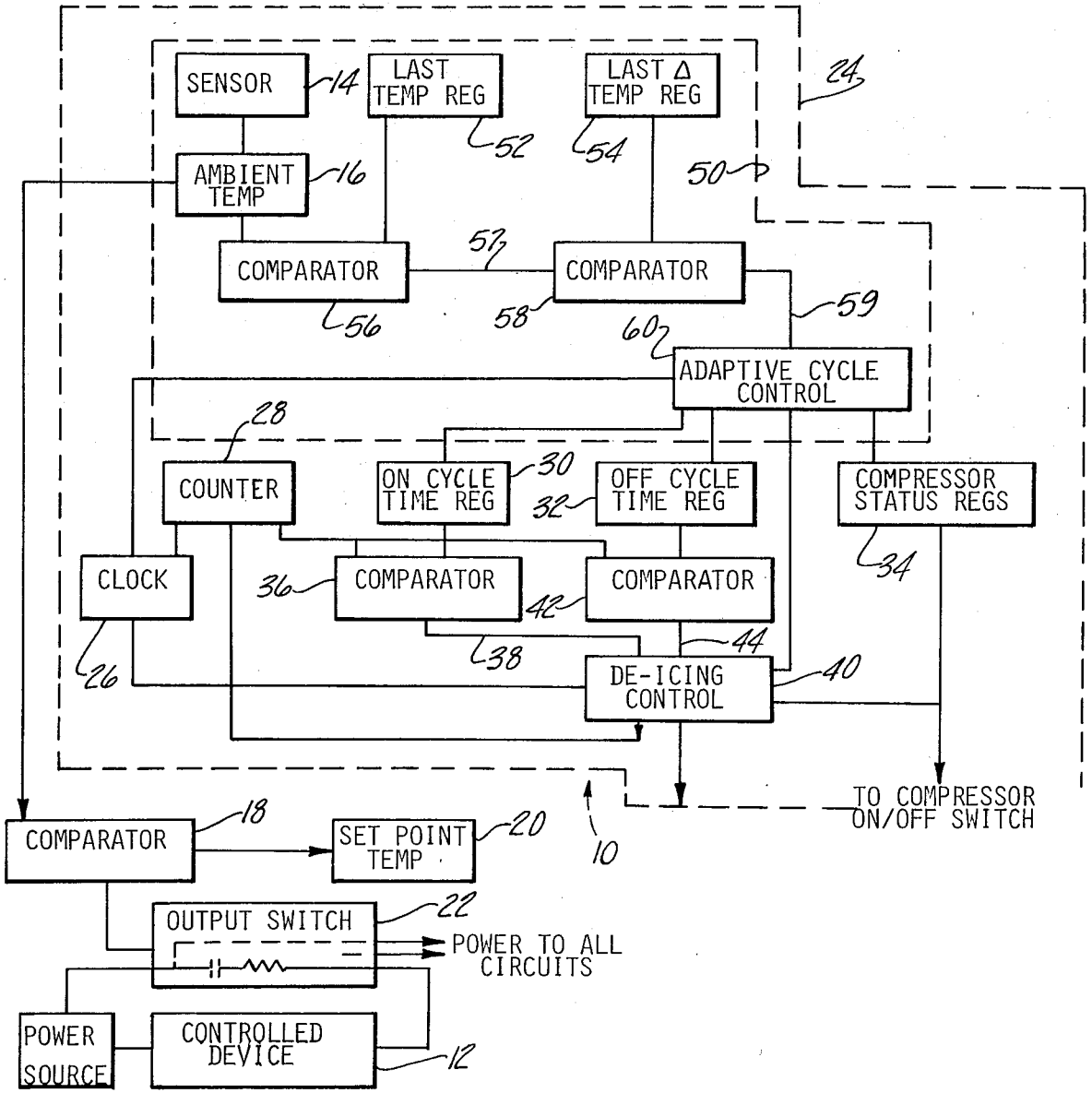
FIG. 1 is a schematic drawing of the adaptive de-icing of the present thermostat of the present invention with the components corresponding to the adaptive cycle-adjusting means enclosed by broken lines.

Referring to FIG. 1, the electronic thermostat of the present invention, generally indicated at 10, is connected to an air-cooling device 12 and/or a other temperature modifying apparatus to control the operative state of the apparatus. The thermostat 10 includes means for automatically de-icing the air-cooling unit 12 in order to prevent the accumulation of ice in the cooling element of the unit. The thermostat 10 is preferably of the general type disclosed in my U.S. Pat. Nos. 4,172,555; 4,206,872; 4,335,847; 4,356,962; and 4,410,132 in that it is microprocessor-based. The thermostat 10 is adapted to be disposed within a structure cooled (or heated) by the air cooling unit or other controlled temperature modifying device 12 to which the thermostat 10 is connected. The thermostat 10 further includes a sensor 14 operative to generate an analog electronic signal representative of the instantaneous temperature in the vicinity of the thermostat 10. The output of the sensor 14 is provided to an ambient temperature generating circuit 16 to establish a digital signal proportional to the ambient temperature. This ambient temperature signal is provided to a digital comparator 18. Means 20 for generating a desired setpoint temperature is also provided and supplied to the digital comparator 18. The setpoint temperature may be in the form of a conventional storage location containing a desired setpoint temperature manually adjusted by the user, as in a conventional thermostat, or may be derived from a stored program of desired temperatures over a repetitive time cycle as disclosed in my above-identified patents. The digital comparator 18 generates a control signal to an output switch 22 based upon a comparison of the ambient temperature and desired setpoint temperatures which acts to energize or deenergize the controlled device 12 as may be required. Additional details concerning the components described above may be obtained by referring to my aforementioned patents which are incorporated herein.

The thermostat also includes means, generally indicated at 24, for automatically initiating a de-icing cycle for a first perselected period of time whenever the air-cooling unit 12 has operated continuously for a second preselected time period in order to prevent the accumulation of ice on the cooling element of the unit. In its simplest form, the de-icing portion 24 of the thermostat includes a clock 26 which provides a stable periodic pulse to a counter 28, and storage means indicated as off cycle time register 32 and on cycle time register 30 for storing first and second preselected time values corresponding respectively to the period of time that the compressor is maintained in the deenergized state during the de-icing cycle and the maximum continuous run time for the air unit compressor. A compressor status register 34 contains a digital value representative of the status of the compressor. The compressor status may simply be a binary value indicating whether the compressor unit is on or off. A first digital comparator 36 receives the values from the counter 28 and on cycle time register 30 and provides an output signal on line 38 to the de-icing control logic 40 whenever the value in the counter exceeds the "on cycle" time limit. Likewise, a second digital comparator 42 receives the values stored in the counter 28 and the off cycle time register 32 and issues a signal on line 44 to the de-icing control logic 40 whenever the value of the counter exceeds the "off cycle" time.

In a first embodiment of the present invention, the de-icing, preferably in the form of a micro-code program, control logic 40 utilizes the control signals received on lines 38 and 44 and the compressor status from compressor status register 34 and issues a control signal to the air cooling unit 12 compressor to energize or reenergize the compressor in accordance with the routine described below.

Figure 3:
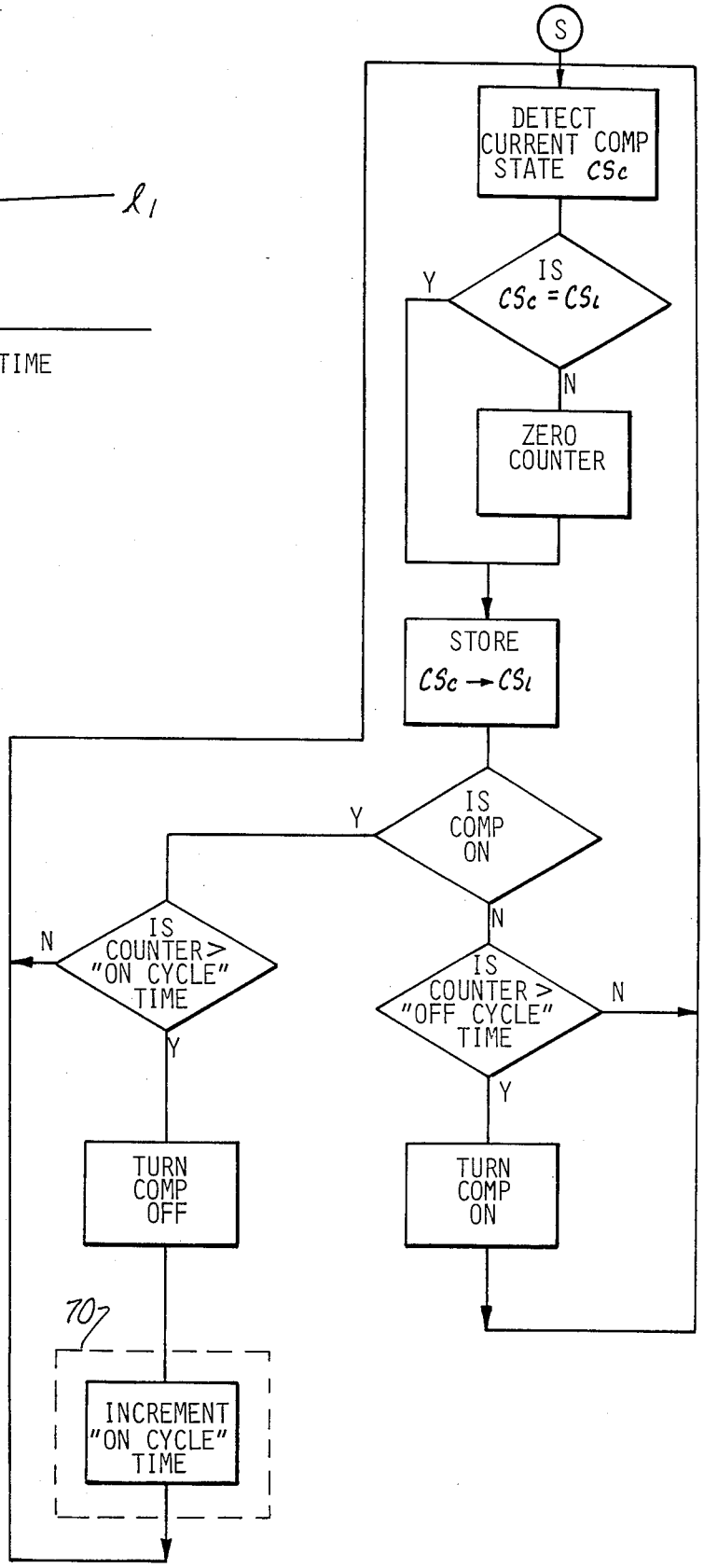
FIG. 3 is flowchart outlining the counting logic employed in the first embodiment of the present invention.

Referring now to FIG. 3, the de-icing control logic 40 obtains the current compressor state $CS_c$ corresponding to the current operative state of the compressor and compares this value to the compressor state value $CS_1$ obtained during the previous clock period. If the current compressor state is different from the last compressor state, the value in the counter is zeroed out to indicate that this is the beginning of an "on" or "off" cycle. If the compressor is on, the value of the counter is compared to the first preselected time period corresponding to the "on cycle" time. If the value of the counter exceeds this time limit, the de-icing control logic generates a control signal which turns the compressor off. Thus, when the compressor has continuously operated for a period of time exceeding the preselected "on cycle" time limit, the de-icing logic automatically deenergizes the compressor, thus beginning a de-icing or "off cycle", in order to allow the cooling element to warm up and prevent any ice from accumulating on the element. The de-icing control logic then returns to its initial point shown at the top of the flowchart in FIG. 3, and repeats its analysis for the next clock period.

Assuming, for example, that the compressor was turned off during the previous clock period, the deicing control logic 40 will determine that the compressor state has changed from "on" to "off" and will zero out the counter. When the compressor is determined to have been in the "off" state for a period of time exceeding the "off cycle" time, the de-icing control logic will generate a control signal to restart the compressor. In the preferred embodiment, the "on cycle" time will be of a value representative of the average length of time an average air-cooling compressor can continue to operate before ice begins to accumulate on the cooling element. Similarly, the "off cycle" time will be of a value, such as five minutes, representing the average amount of time a typical unit's compressor needs to be shut down in order for any accumulated ice to melt. Program input means may be provided to allow the user to alter these values according to the requirements of his particular unit, or the values may be adaptively adjusted by the thermostat in a manner described in further detail below.

Referring again to FIG. 1, an alternative embodiment of the present invention includes means, generally indicated within the smaller box at 50, for adaptively adjusting the "on cycle" and "off cycle" times utilized in the de-icing cycle. This adaptive adjusting means 50 includes a last temperature register 52 for storing the value of the ambient temperature obtained during the previous clock period, a last Δ temperature register 54 for storing the Δ temperature value computed during the previous clock period, a pair of comparators 56 and 58 and adaptive cycle control logic 60. It should be noted that the last temperature register, last Δ temperature register, "on cycle" time register, "off cycle" time register, and compressor status registers typically take the form of specific locations in a conventional random access memory but that any type of conventional digital storage device may be utilized for storing these values without departing from the spirit of the invention. As with the de-icing control logic 40, the adaptive cycle control logic 60 is preferably a micro-code program residing in a suitably programmed microprocessor in the thermostat.

Figure 2:
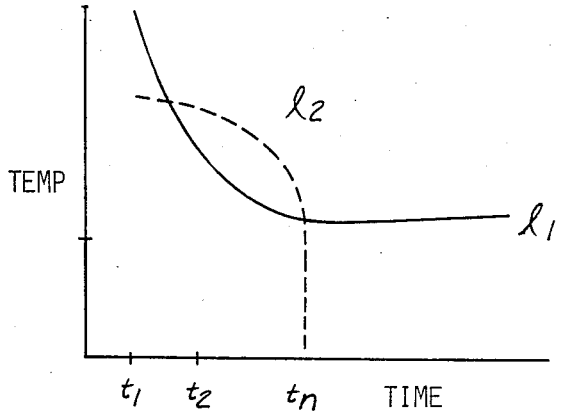
FIG. 2 is a graphic representation of the rate of temperature change within a building employing a cooling system without automatic de-icing means.

The cooling curve in a room cooled by a continuously running air cooling unit is illustrated in FIG. 2. The solid line $l_1$ represents the change in ambient temperature over time when an air cooling unit controlled by a conventional thermostat is allowed to run after the temperature has been set back for a period of time. Since the temperature $t_1$ is relatively high compared to the current desired temperature setpoint because the temperature has been set back (or in this case, the room has been allowed to warm up), the sharp slope of the curve during the initial time period bounded by $t_1$ and $t_2$ shows a significant temperature drop and, thus, efficient cooling of the room. However, as the unit continues to operate and the ambient temperature of the room continues to approach the desired temperature setpoint $T_0$, the temperature differential between the ambient temperature and the cooling element is reduced, thus reducing the cooling efficiency of the unit. When the temperature difference between the setback temperature $T_1$ and the desired setpoint $T_0$ is large enough, the continuous operation of the compressor for long periods tends to cause the condensate on the cooling element of the air cooling unit to ice up. At this point in time, $t_n$, the cooling efficiency of the unit greatly deteriorates as indicated by the nearly horizontal portion of the cooling line $l_1$. If the rate of change in the change in temperature per unit of time is plotted for the cooling curve shown as $l_1$, the curve looks somewhat like that shown as dotted line $l_2$. It should be noted that this curve displays a precipitous drop towards 0° per second$^2$ at time $t_n$. This precipitous drop in the rate of change in the cooling rate towards 0 indicates the drastic loss in efficiency that is experienced whenever ice begins to accumulate on the evaporator of the cooling unit. The adaptive adjusting control of the present invention monitors the change in the cooling rate on a periodic basis in order to determine when this precipitous loss of efficiency occurs, and adjusts either or both of the "on cycle" and "off cycle" times to maximize the effectiveness of the de-icing cycle.

Figure 4:
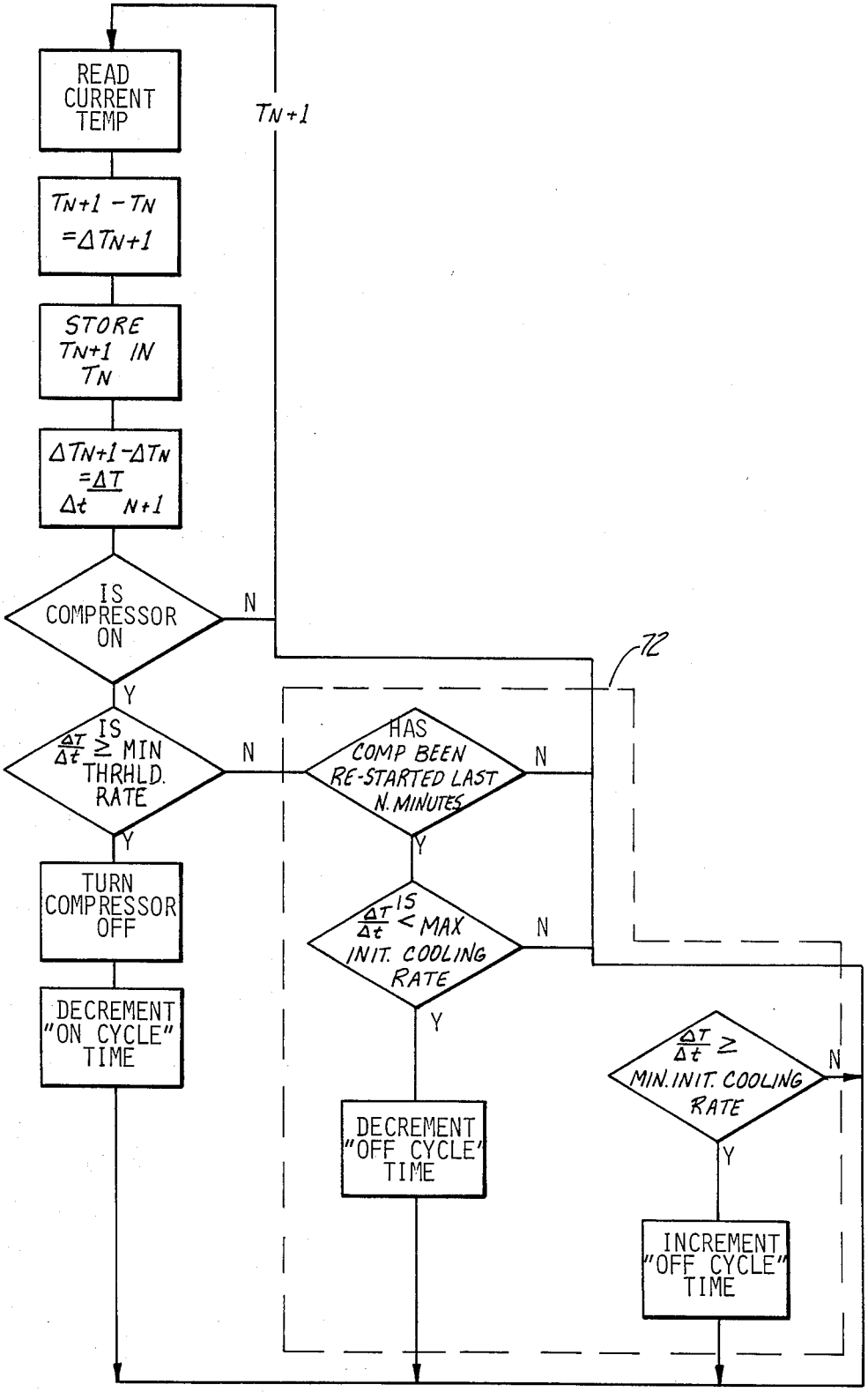
FIG. 4 is a flowchart outlining the adaptive modification logic which may be employed in the present invention.

The flowchart shown in FIG. 4 illustrates the functions performed by the adaptive cycle control logic 60 of the present invention. At each clock period a current temperature value is obtained from the ambient temperature generator 16 and supplied to comparator 56 along with the ambient temperature obtained during the previous clock period stored in the last temperature register 52. The difference between these values is taken to determine a change in temperature for that period of time and this value is supplied on line 57 to comparator 58 where this cooling rate is compared to the cooling rate calculated for the temperature readings obtained in the first preceding and second preceding clock periods (stored in the last Δ temperature register 54), this difference, representing the change in the cooling rate during the previous two clock periods, is then provided along line 59 to the adaptive cycle control logic 60. If the compressor unit is currently on and the change in the cooling rate is greater than the preselected minimum threshold rate, no action is taken. It should be noted that a decrease in the "cooling rate" corresponds to an increased (i.e.less negative) value of degrees/second-/second.

If the change in the cooling is less than or equal to the minimum threshold rate (i.e. the change in temperature/second is greater than or equal to the threshold rate), the adaptive cycle control logic 60 issues a control signal to deenergize the compressor. The "on cycle" time value is then decremented by one unit in order to shorten the "on cycle" time during the next cycle. It should be noted that in this embodiment of the invention, de-icing control logic 40 operates simultaneously with the adaptive cycle control logic 60. If the counter 28 exceeds the "on cycle" time before the change in cooling rate exceeds the minimum threshold rate, the de-icing control logic 40 will turn the compressor off as described above in connection with the first embodiment of the invention. The de-icing control logic 40 will then also increment the "on cycle" time as shown at 70 in FIG. 3 to lengthen the continuous running time of the compressor during the next cycle since the previous "on cycle" time lapsed before the adaptive cycle control logic 60 determined that there was a precipitous drop in cooling efficiency. In this manner, the length of the "on cycle" of the compressor may be increased or decrease adaptively by this system as a function of the current changes in the cooling rate of the system.

The adaptive cycle control logic 60 may also include means for adaptively adjusting the length of the "off cycle" time in the manner shown within the dotted box 72 in FIG. 4. A pair of cooling rates representing a range of desirable cooling rates for the restarted compressor are stored in suitable registers (not shown). After calculating the change in the cooling rate in the manner described above, the adaptive cycle control logic 60 determines whether the compressor has been restarted. That is, the counter is interrogated to determine whether the compressor has been running continuously for a time period less than a preselected number of minutes. If the compressor is determined to be in restart mode, the change in the cooling rate is compared to the maximum initial cooling rate and minimum initial cooling rates to determine whether the present change in the cooling rate is within this acceptable range. If, for example, the change in the cooling rate is determined to be greater than the maximum initial cooling rate, the "off cycle" time is decremented by one unit. If, however, the change in the cooling rate is less than the minimum initial cooling rate (a condition indicating that the accumulated ice has not been completely removed from the evaporator) the "off cycle" time is incremented by one unit.

Thus, the system of the present invention provides an electronic thermostat with a de-icing cycle for automatically deenergizing the compressor in an air cooling unit for a first preselected period of time when that compressor has operated continuously for a second preselected period of time in order to inhibit or remove any accumulated ice from the cooling element of the unit. The system of the present invention may further include, as illustrated in the box 50 of FIG. 1, means for adaptively adjusting the "on cycle" and/or "off cycle" times as a function of the calculated change in the cooling rate of the cooling unit 12.

What is claimed is:

1. In an electronic thermostat adapted to be connected to an air-cooling apparatus to control the operative state of the apparatus and including means for generating a digital electrical signal representative of a desired temperature setpoint and means for generating a digital electrical signal representative of the ambient temperature at the thermostat, the improvement comprising:

means for generating control signals for the aircooling apparatus in order to inhibit the accumulation of ice on the cooling element of the air-cooling apparatus when the ambient temperature is above the temperature setpoint;

means, responsive to the control signals, for deenergizing the compressor in the air-cooling apparatus for a first preselected period of time whenever the compressor is determined to have run continuously for a second preselected period of time; and means for adaptively adjusting the length of at least one of the first or second preselected periods of time as a function of the change in the rate of change of the ambient temperature.

2. A de-icing thermostat for an aircooling apparatus including:

a stable periodic signal source;

a digital counter responsive to the periodic signal source;

first storage means for storing a preselected maximum run time for the compressor pump in the air-cooling apparatus;

second storage means for storing a preselected off cycle time for the compressor pump in the air-cooling apparatus;

control means for loading the digital counter with the maximum run time value and decrementing said value until it reaches zero, and, thereupon, generating control signals for the compressor pump in the air-cooling apparatus in order to deenergize the compressor to inhibit the accumulation of ice on the cooling element in the air-cooling apparatus, the control means thereafter loading the digital counter with the off cycle time value and decrementing said value until it reaches zero and, thereupon, generating control signals for the compressor pump to reenergize the compressor; and means for adaptively adjusting the preselected maximum continuous run time as a function of the change in the cooling rate measured during the previous operating period.

3. The apparatus of claim 2 wherein the adaptive adjusting means includes:

storage means for storing a preselected minimum threshold change in the cooling rate;

comparator means for comparing the calculated change in the cooling rate with the minimum threshold change in the cooling rate; and means for generating control signal operative to deenergize the compressor on the air-cooling unit when the current change in the cooling rate is less than the preselected threshold.

4. A system for preventing ice build-up on the compressor of an air conditioner having a separately controllable fan, the system comprising:

thermostatic control means for generating an on signal when the ambient temperature arises above a predetermined level;

air conditioner control means for turning on the air conditioner fan and energizing the compressor while the on signal is present and for turning off the air conditioner fan and deenergizing the compressor when the on signal is not present; and timing means for deenergizing the compressor for a first time period after a second time period has elapsed to prevent buildup of ice on the compressor, wherein the timing means includes means for adaptively adjusting the length of the second time period as a function of the change in the rate of change in the ambient temperature while the on signal is present.

* * * * *

UNITED STATES PATENT AND TRADEMARK OFFICE

CERTIFICATE OF CORRECTION

PATENT NO. : 4,627,245

DATED : December 9, 1986

INVENTOR(S) : Michael R. Levine

It is certified that error appears in the above-identified patent and that said Letters Patent is hereby corrected as shown below:

Column 2, line 16 "occur for an extended" should be --occur where the unit is required to operate continuously for an extended--.

Claim 1, line 9 "aircool-ing" should be --air-cooling--.

Signed and Sealed this

Fifteenth Day of September, 1987

*Attest:*

DONALD J. QUIGG

*Attesting Officer*

*Commissioner of Patents and Trademarks*